US005423098A

United States Patent [19]

Swezey et al.

[11] Patent Number: 5,423,098

[45] Date of Patent: Jun. 13, 1995

[54] BED LOUNGE

[76] Inventors: Robert L. Swezey, 10532 Garwood Pl., Los Angeles, Calif. 90024; Richard Swezey, 148 N. Wilton Pl., Los Angeles, Calif. 90004

[21] Appl. No.: 273,596

[22] Filed: Jul. 11, 1994

[51] Int. Cl.[6] ..... A47C 20/00

[52] U.S. Cl. ..... 5/633; 5/653; 297/440.12; 297/410

[58] Field of Search ..... 108/43; 297/181, 230.1, 297/410, 440.12; 5/633, 638, 653, 634

[56] References Cited

U.S. PATENT DOCUMENTS

| | | | |
|---|---|---|---|
| Re. 25,936 | 12/1965 | Throssel | 297/440.12 |
| 2,856,614 | 10/1958 | O'Leary | 5/633 |
| 2,940,511 | 6/1960 | Games | 297/440.12 |
| 3,293,669 | 12/1966 | Emery | 5/633 |
| 4,385,782 | 5/1983 | Clark, Jr. | 5/440.12 |
| 4,700,634 | 10/1987 | Mills et al. | 108/43 |
| 4,909,573 | 3/1990 | Barry et al. | 297/181 X |
| 5,214,816 | 6/1993 | Collins | 5/633 X |

FOREIGN PATENT DOCUMENTS

| | | | |
|---|---|---|---|
| 1196483 | 11/1959 | France | 5/633 |

*Primary Examiner*—Michael F. Trettel
*Attorney, Agent, or Firm*—J. E. McTaggart

[57] ABSTRACT

An ergonomic bed lounge is made with a fabric slip-cover enclosing foam padding on a main structure that is formed from plastic sheet material to provide the required strength while keeping the weight ultra light: lighter than all-foam construction. Side arms are provided that can pivot inwardly for storage and outwardly for entry/exit, for providing different resting conditions and for comfortable accommodation of different-sized users. The side arms are each equipped with a convenient storage pocket. A lower back support pillow is removably contained in pockets provided in the slip cover in a manner that enables the user to locate and orient the back pillow for maximum support and comfort. An adjustable neck pillow with an elliptical cross-sectional shape can be adjusted in height and oriented for optimal neck support in terms of head position and attitude. An accessory lap desk is fitted with a padded underside pouch by which it may be supported on the user's legs to provide a writing surface on the top side. The lap desk contains a storage compartment that is accessible through a top cover that forms the writing surface.

13 Claims, 5 Drawing Sheets

BED LOUNGE

FIELD OF THE INVENTION

The present invention relates to household bedding accessory furniture and more particularly it relates to a back support for a user seated upright on a flat surface such as bed.

BACKGROUND OF THE INVENTION

For those who spend periods of time sitting in bed, or for that matter sitting on a floor or against a wall, it is important to provide proper support to the body to avoid discomfort, fatigue and/or body deformation.

PRIOR ART

Bedding furniture in the field of this invention has been known under such names as "bed bolster", "husband" and "study rest". Typically such items have been made entirely from foam material so that characteristically they lack support, being overly soft and flexible, and/or they are inconveniently heavy.

OBJECTS OF THE INVENTION

It is a primary object of the present invention to provide a bed lounge with back support structure for a user seated upright on a flat surface such as a bed.

It is a further object to provide, in the bed lounge, special adjustable lower back region support structure that can be adjusted by the user.

It is a further object to provide special neck region support structure that can be adjusted by the user both for height and for attitude.

It is a further object that the back support structure be sufficiently strong yet light in weight, e.g. considerably lighter than a structure of comparable strength constructed solely of fill material such as foam.

It is a further object that the back support structure be made highly portable: easy and quick to be removed from the bed to the bedside, and easily transported and stored.

It is a further object that the back support structure be made strong enough to support heavy individuals and also to withstand being dropped or thrown from the bed.

It is a further object to provide adjustable arm supports that can be spread outwardly for easy entry/exit, for different resting conditions and to accommodate persons of different size, and that can be folded inwardly for storage.

It is a further object to provide convenience storage regions within the bed lounge.

It is a further object to provide an accessory lap desk for use in conjunction with the bed lounge.

SUMMARY OF THE INVENTION

The above and further objects and advantages have been realized in the present invention of a bed lounge that is built around a main structure formed from plastic providing required strength along with light weight. The side arms can pivot inwardly and outwardly. An adjustable lightweight pillow is provided for lower back support, retained by accessible pockets. An oval-shaped adjustable neck pillow can be adjusted to the user's comfort: it can be set for height and can be rotated for head position and attitude. An accessory lap desk with a padded pouch to rest on the lap and legs provides a writing surface and storage.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
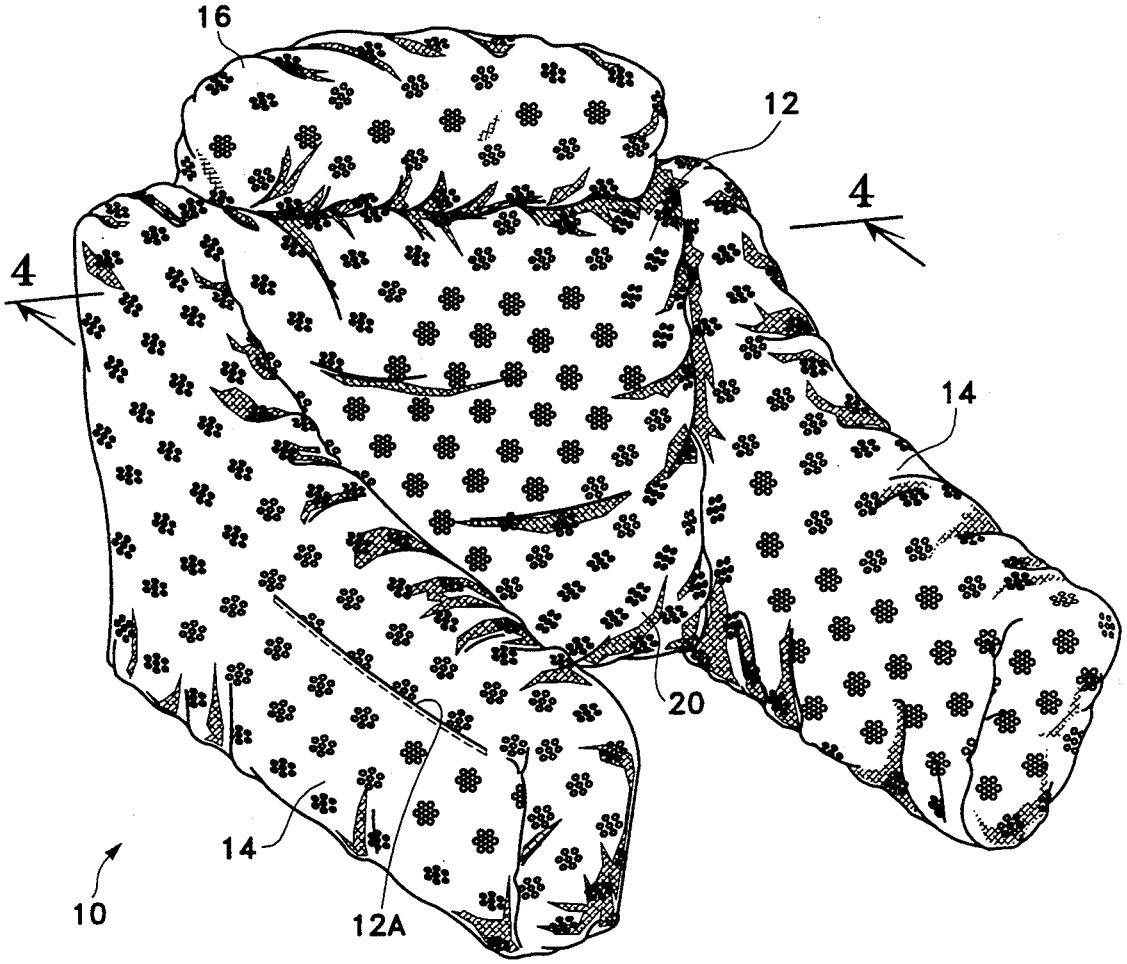
FIG. 1 is a perspective view of a bed lounge embodying the present invention, with a patterned print slip cover.

In FIG. 1 is a perspective view of a bed lounge 10 embodying the present invention showing the exterior finished with a removable patterned print fabric slip cover 12. The two side arms 14 extending forwardly each have a hinged frontal portion whereby the frontal portions can be spread outwardly to accommodate users of different sizes, or closed inwardly and tied together or otherwise fastened for storage. A neck pillow 16 is adjustably attached to the main body of the bed lounge 10 by a spine (not visible in this view). Pockets 12A (one shown) in slip cover 12 in arms 14 provide access to convenience storage cavities configured in arms 14. At the lower back region 20 within the slip cover 12 there is provided a positionable pillow (not visible) that can be positioned by the user for optimal lower back support and that is accessible through pockets provided in slip cover 12 in this region on the inside face of the back support. Additional storage space may be provided in this lower back region of the bed lounge 10.

Figure 2:
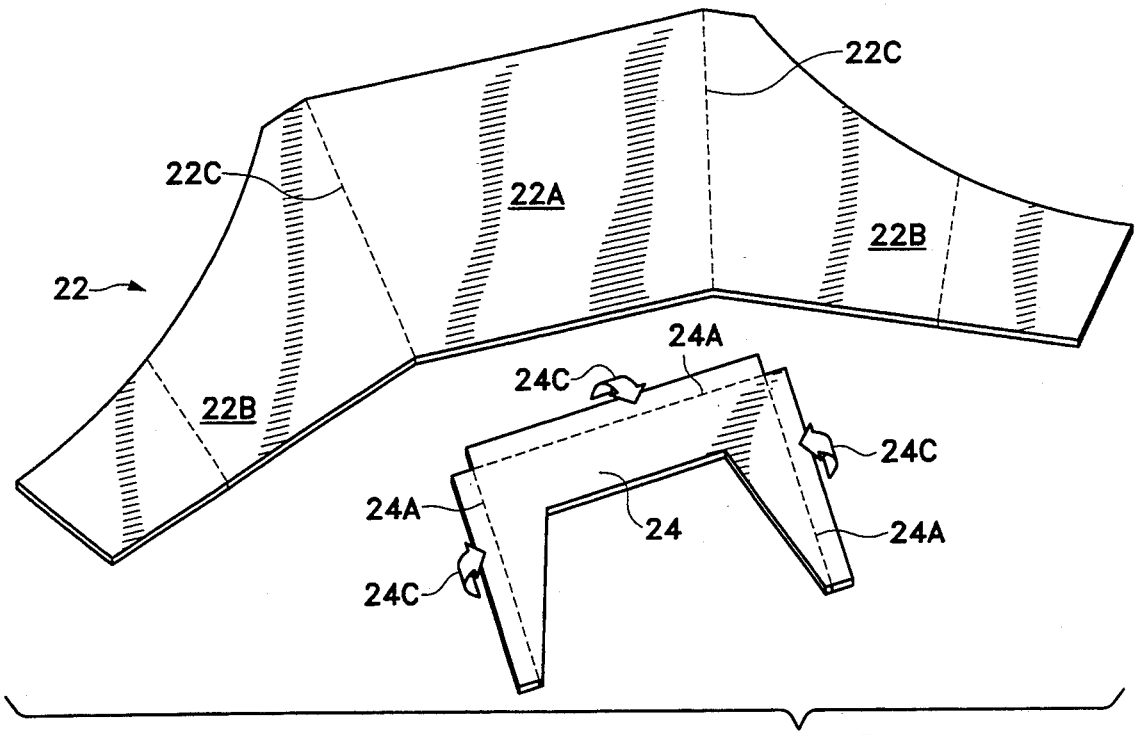
FIG. 2 is perspective view of the two main structural parts of the bed lounge of FIG. 1 in preliminary flat form.

FIG. 2 is a perspective view of the two pieces of strong lightweight plastic sheet material that form the basic structure of the bed lounge 10 of FIG. 1: a main part 22 including a back portion 22A and two arm portions 22B, and a bottom part 24. Both parts are shown in a preliminary flat form in which they are initially cut from the plastic sheeting, typically laminated with a lightweight core, e.g. corrugated or foam-filled. The main part 22 is preprocessed (i.e. embossed or scored) for bending at lines 22C to form rear corners, and the bottom part 24 is similarly prepared at lines 24A along 3 edges for bending upwardly as indicated by arrows 24C.

Figure 3:
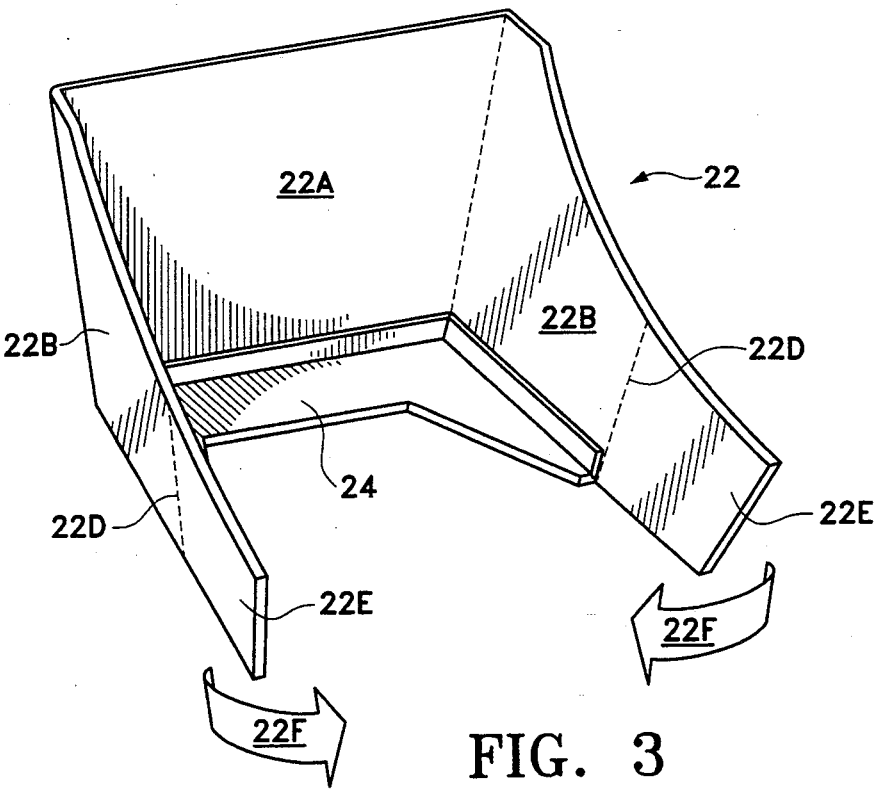
FIG. 3 is a perspective view of the parts in FIG. 2 formed and assembled together.

FIG. 3 shows the parts 22 and 24 of FIG. 2 formed and assembled together, attached by the edge flaps of part 24, typically by sonic welding or rivetting. In the side arms 22B of main part 22, "living" hinges 22D are formed integrally from the basic plastic sheeting material in an embossing process along the dashed lines indicated: these enable the user to pivot the outer portions 22E of arms 22B as indicated by arrows 22F over a total angle of about 180 degrees.

Figure 4:
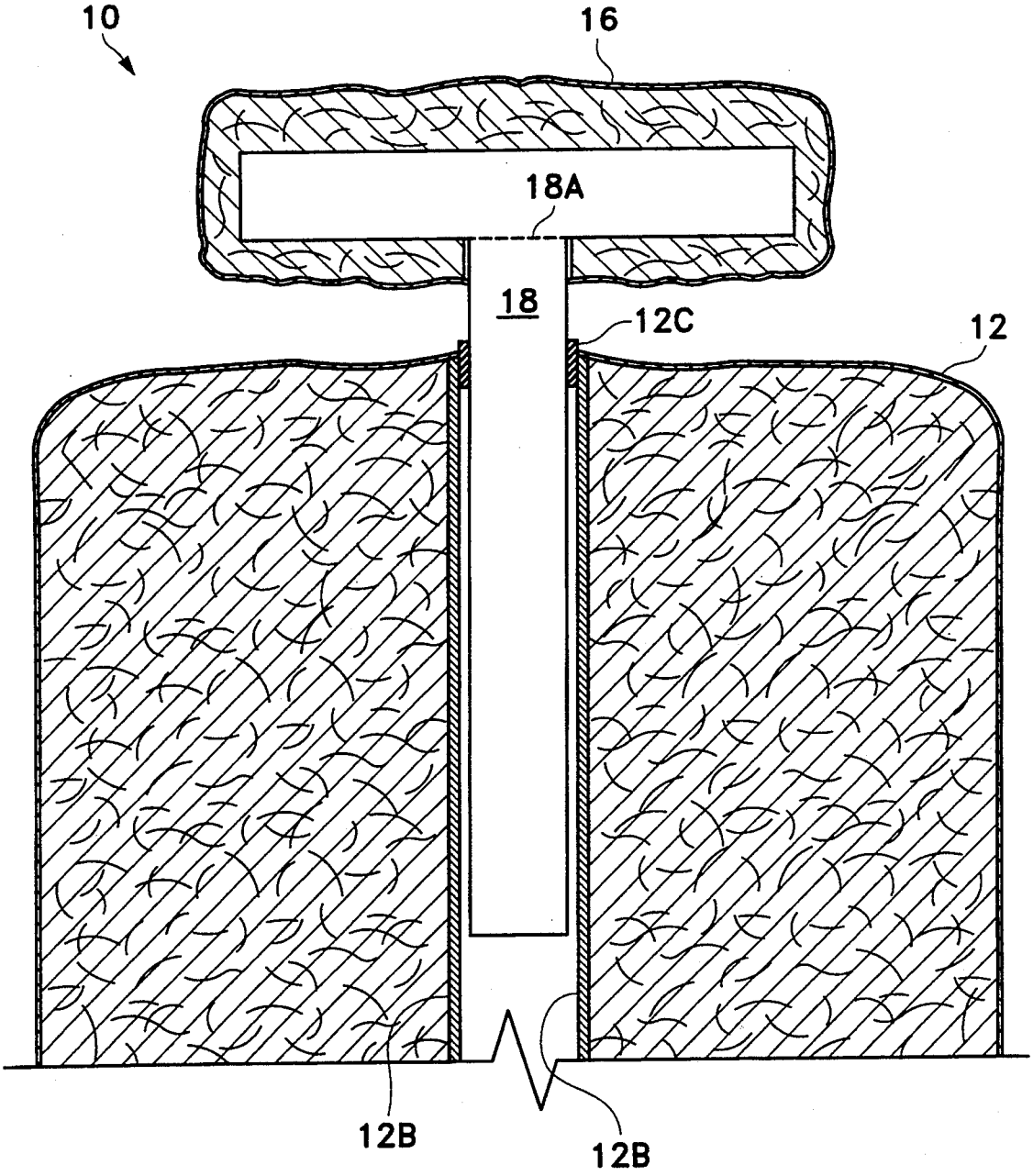
FIG. 4 is a cross-section taken at axis 4–4' in FIG. 1.

In FIG. 4, which is a cross-section at axis 4–4′ of FIG. 1, spine 18 is seen to have a T shape with the upper transverse portion embedded in neck cushion 16. Connecting the upper portion integrally to the lower portion is a living hinge 18A. The downwardly-extending lower portion is enclosed in a passageway 12B sewn into the fabric of slipcover 12 at the rear of bed lounge 10. The upper end of passageway 12B is made to have a snug fitting collar 12C which may be made from frictional fabric such as is found in hook-and-loop fastening material. Passageway 12B and collar 12C act on spine 18 with an amount of friction that allows the user to select the height of neck cushion 16 above the main body of the bed lounge 10 by shifting spine 18 up or down within the passageway 12B, however the friction is made sufficient to retain neck cushion 16 in place at any selected height. Living hinge 18A enables the user to rotate the oval shaped neck cushion 16 and thus position it to a desired attitude to best support the neck and head regions of the user.

Figure 5:
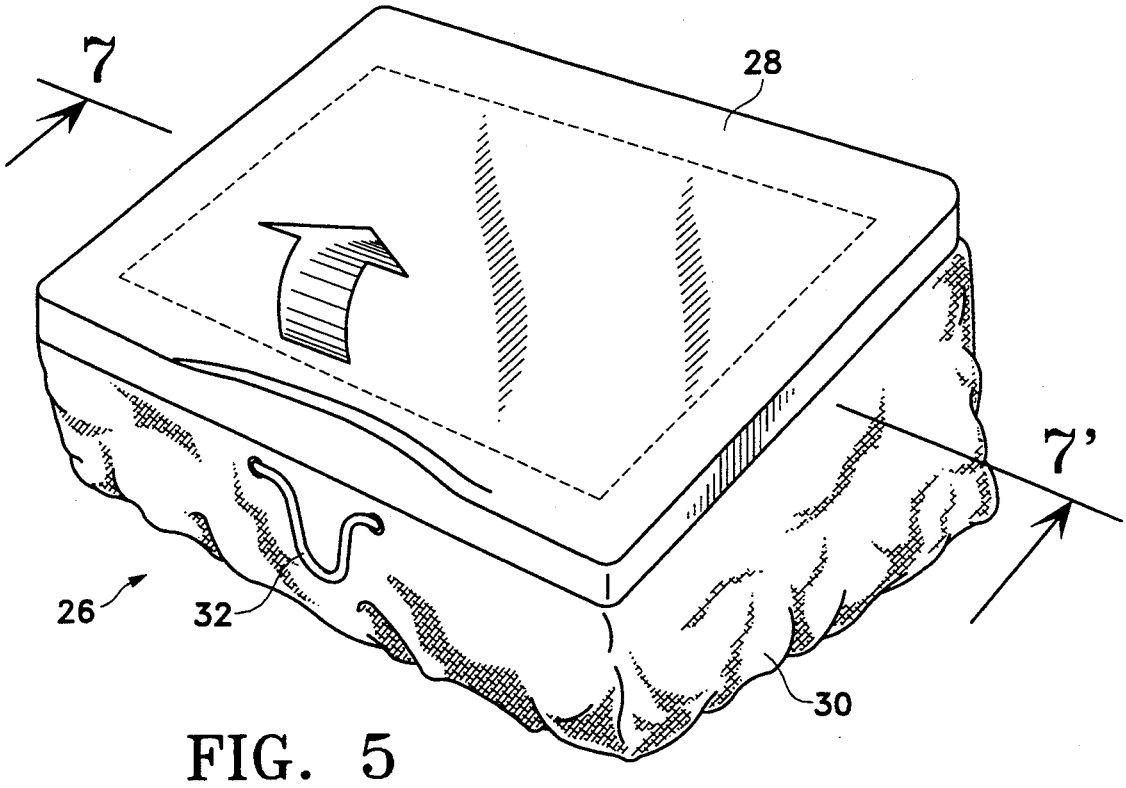
FIG. 5 is a perspective view of a soft lap desk provided as an accessory with the bed lounge of FIG. 1.

FIG. 5 is a perspective view of an accessory soft lap desk 26 that may be supplied as part of the bed lounge of the present invention. Lap desk 26 has a firm rectangular cover 28 that forms a work surface in the closed position shown. The lower portion 30 of the lap desk is made soft and padded, typically with synthetic down material enclosed in a pouch so as to enable it to be retained optimally on the lap of the user. Lap desk 26 is equipped with a handle 32 and its lower portion is attached around its upper edge to a concealed firm portion that mates with the cover 28.

Figure 6:
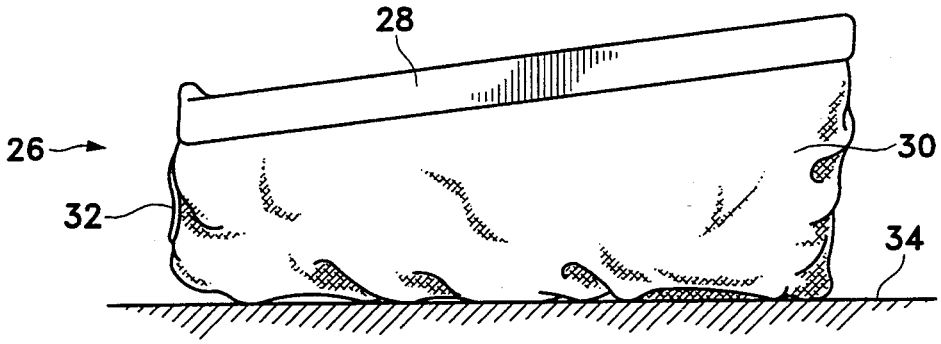
FIG. 6 is a side view of the lap desk of FIG. 5.

FIG. 6 is an end view of the lap desk of FIG. 5 showing cover 28 and lower portion 30 with handle 32, the whole resting on a flat surface 34.

Figure 7:
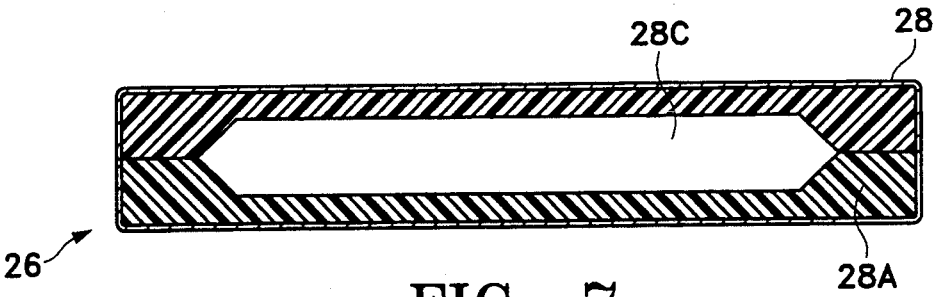
FIG. 7 is a cross sectional view of the upper portion of the lap desk of FIG. 5 taken at axis 7–7'.

FIG. 7 is cross section of an upper portion of the lap desk 26 of FIG. 5 taken through axis 6–6′ thereof. It is seen that there is a lower firm portion 28B that mates with cover 28, and both parts are configured internally to provide an interior storage region 28C as shown.

Figure 8:
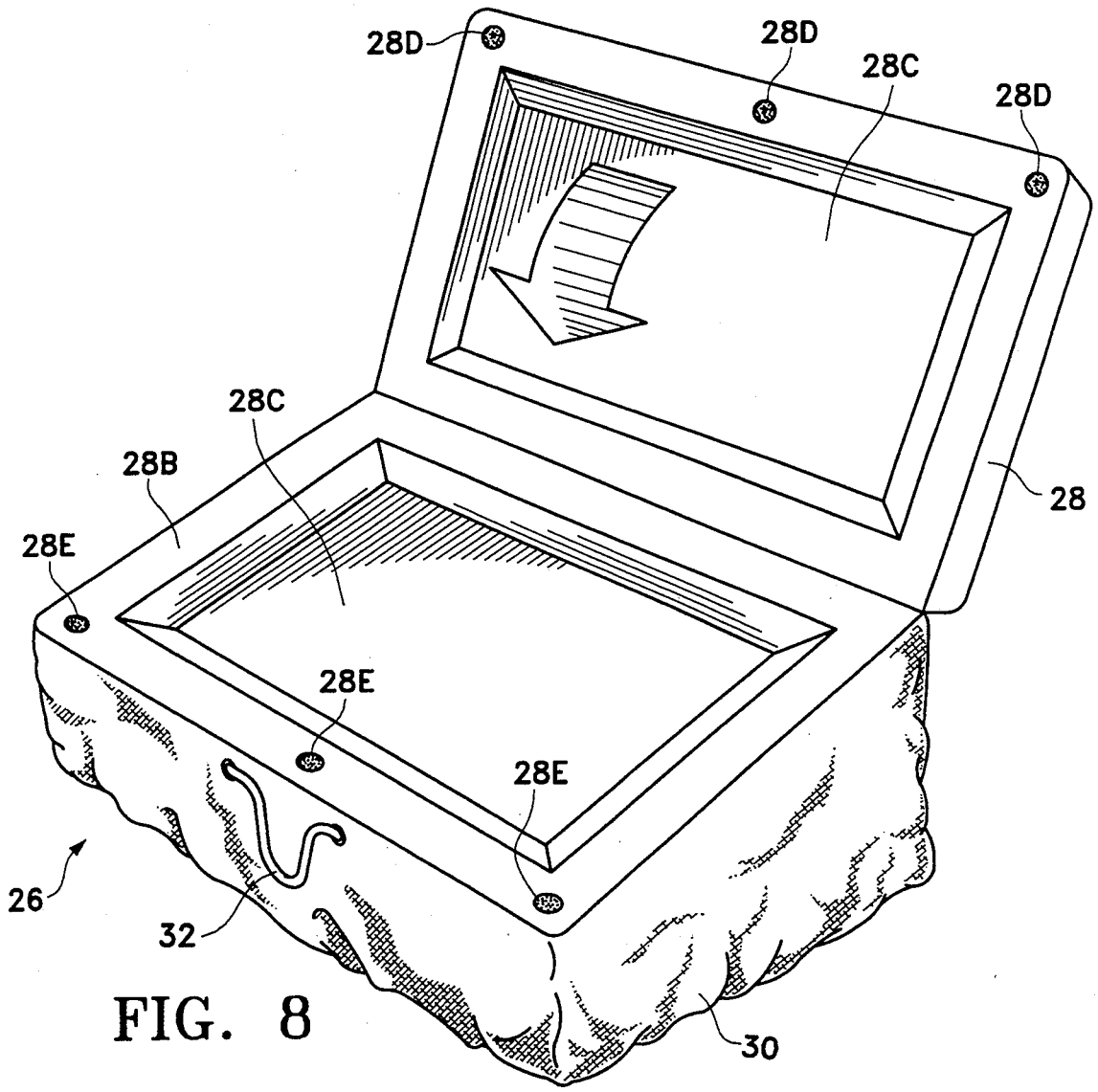
FIG. 8 is a perspective view of the lap desk of FIG. 5 with the cover open.

FIG. 8 is a perspective view of the lap desk 26 with its cover 28 raised to an open position showing the storage region 8C. Three pairs of hook-and-loop fastening pads 28D and 28E are provided to hold cover 28 in place when closed.

Figure 9:
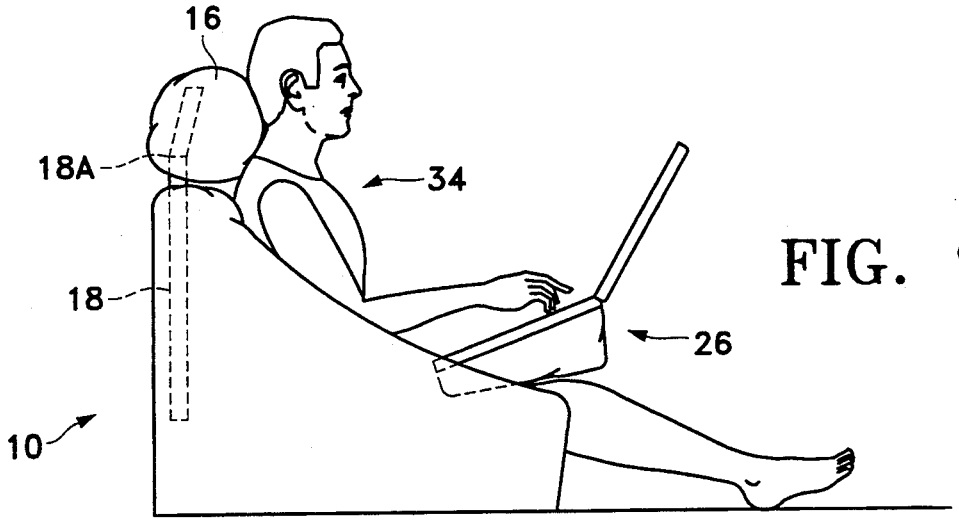
FIG. 9 is a side view showing the bed lounge of FIGS. 1–3 in use along with the lap desk of FIGS. 5–8.

FIG. 9 is a side view of a user 34 seated in the bed lounge 10, the user's neck resting against the neck pillow 16 which is supported by spine 18 containing living hinge 18A. The lap desk 6 is shown in use in its open position as in FIG. 8.

Optionally a mirror may be provided on the inside surface of the hinged cover 28. As a further option the lap desk may be provided with an adjustable, retractable reading lamp and/or interior lamp.

As an alternative to laminated plastic sheeting as the material in the main structural parts, the material may be made of solid plastic, configured with large voids to reduce weight and material cost.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A bed lounge, for supporting a user in a sitting position, comprising:

a main support structure, made from flat plastic sheet material to provide strength and light weight, having a back portion and having, attached thereto and extending forwardly therefrom, a pair side arms, one at each side thereof;

foam padding covering said main support structure;

a fabric slip cover enclosing said main support structure and said foam padding;

a lower back pillow, incorporated in said bed lounge, for supporting a lower back region of the user's body;

a neck pillow, for supporting a neck region of the user's body, including adjustable neck pillow support means for positioning and retaining said neck pillow in an upper rear region of said bed lounge; and hinge means in the side arms of said main support structure for allowing a forward portion of each arm to be pivoted both outwardly and inwardly.

2. The bed lounge as defined in claim 1 wherein said lower back pillow is captivated in a floating manner within said slip cover so as to enable the user to adjustably locate and orient said lower back pillow for user comfort.

3. The bed lounge as defined in claim 1 wherein said neck pillow support means comprises a T-shaped spine having an upper transverse portion embedded in said neck support pillow and a downwardly-extending vertically-elongated leg portion enclosed and frictionally retained, in a passageway provided in said slip cover at a back region of said bed lounge, in a manner to allow the user to adjust said neck support pillow with regard to height.

4. The bed lounge as defined in claim 3 wherein the upper transverse portion of said spine is attached to the leg portion thereof by a living hinge, formed integrally in said spine, that allows the user to rotationally adjust the neck support pillow with regard to attitude.

5. The bed lounge as defined in claim 3 further comprising, as part of the passageway formed in said slip cover at an upper end thereof, a fabric collar frictionally engaging the leg portion of said spine.

6. The bed lounge as defined in claim 5 wherein said adjustable neck pillow support means further comprises fastening means for securing said neck support pillow in a selected position.

7. The bed lounge as defined in claim 1 wherein said main support structure comprises:

a main part, including the back portion and the two arms, made from flat plastic sheet material and folded approximately perpendicularly along two rear corner fold lines demarking the back portion and the side arms; and a bottom part, made from flat plastic sheet material, having upwardly-folded flaps on three sides attached to a lower edge of said main part along the back portion thereof and along a rearward portion of each of the two arms thereof.

8. The bed lounge as defined in claim 1 further comprising in each of the arms on an outward-facing side thereof a convenience storage cavity region, each made accessible to the user through a corresponding pocket slot provided in said slip cover.

9. The bed lounge as defined in claim 1 further comprising a lap desk having a flat upwardly-facing writing surface and having in a lower region thereof a soft down-filled pouch for supporting said lap desk on the legs of the user.

10. The bed lounge as defined in claim 9 wherein said lap desk further comprises:

a hinged cover configured to provide the writing surface; and, an internal storage region accessible to the user via said hinged cover.

11. A bed lounge, for supporting a user in a sitting position, comprising:

a main support structure, made from strong lightweight flat plastic sheet material, having a back portion and having, attached thereto and extending forwardly therefrom, a pair of arms, one at each side thereof, said main support structure comprising a main portion, including the back portion and the two arms, folded approximately perpendicularly along two rear corner fold lines demarking the back portion from the arms; and a bottom portion, made from flat plastic sheet material, having upwardly-folded flaps on three sides attached to a lower edge of said main portion along the back portion thereof and along a rearward portion of each of the two arms thereof;

foam padding covering said main support structure;

a fabric slip cover enclosing said main support structure and said foam padding;

a neck pillow, having a generally elliptical cross-sectional shape, disposed in an upper rear region of said bed lounge;

a T-shaped support spine having a horizontal transverse upper portion embedded in said neck pillow and integrally attached by spine hinge means to a vertically elongated lower portion extending downwardly, enclosed and frictionally engaged by a passageway configured in said slip cover at a rear central region of said bed lounge, whereby said neck pillow is supported in place and whereby the user is enabled to adjust said neck pillow with regard to height and attitude;

a lower back pillow, located on a forward-facing side of the back portion in a lower region thereof, removably contained within said slip cover in a manner to enable the user to adjust the location and orientation of said lower back pillow for user comfort;

arm hinge means in the arms of said main support structure enabling a forward portion of each arm to be pivoted both outwardly away from each other and inwardly toward each other, each of the forward portions being configured to provide on an outward-facing side thereof a convenience storage region made accessible to the user through a pocket slot provided in said slip cover.

12. The bed lounge as defined in claim 11 further comprising a lap desk having a flat upwardly-facing writing surface and having in a lower region thereof a soft pouch for supporting said lap desk on the legs of the user, said lap desk having a hinged cover configured to provide the writing surface and having an internal storage region accessible to the user via the hinged cover.

13. The bed lounge as defined in claim 11 wherein said arm hinge means and said spine hinge means comprise living hinges formed integrally in the plastic sheeting materials of the arms and the spine.

* * * * *